United States Patent [19]

Coleman, III

[11] Patent Number: 4,528,431

[45] Date of Patent: Jul. 9, 1985

[54] ROCKING SWITCH ACTUATOR FOR A LOW FORCE MEMBRANE CONTACT SWITCH

[75] Inventor: Edwin T. Coleman, III, Versailles, Ky.

[73] Assignee: International Business Machines Corporation, Armonk, N.Y.

[21] Appl. No.: 538,728

[22] Filed: Oct. 3, 1983

[51] Int. Cl.[3] ..... H01H 13/30

[52] U.S. Cl. ..... 200/67 A; 200/5 A; 200/159 B; 200/340

[58] Field of Search ..... 200/159 B, 67 A, 67 C, 200/340, 5 A

[56] References Cited

U.S. PATENT DOCUMENTS 4,118,611 10/1978 Harris ..... 200/67 A
4,479,040 10/1984 Denley et al. ..... 200/159 B

FOREIGN PATENT DOCUMENTS 64615 11/1982 European Pat. Off. ..... 200/340
2501410 9/1982 France ..... 200/5 A

*Primary Examiner*—Stephen Marcus
*Assistant Examiner*—Renee S. Kidorf
*Attorney, Agent, or Firm*—Frank C. Leach, Jr.

[57] ABSTRACT

A pivoting rocking actuator has a first bottom surface, which comprises two spaced portions, resting on an upper surface of a membrane contact switch assembly when the actuator is in its rest position. The actuator has one end of a buckling spring, which is initially buckled in a selected direction, acting against its upper surface with the other end of the spring acting against a key, which is slidably mounted on a frame, of a keyboard. When the key is depressed, the spring catastrophically buckles in the selected direction to cause initial pivoting of the actuator about a forward edge of each of the spaced portions. This causes a curved bottom surface of the actuator to rotate about a pivot point on the bottom curved surface to close a contact switch of the membrane contact switch assembly. When the key is released, the spring unbuckles at a slower rate than its compression so that there is an initial further rotation of the actuator along the curved bottom surface in the same direction as rotation occurred to close the contact switch. Then, the actuator returns to its rest position to open the contact switch.

23 Claims, 9 Drawing Figures

ROCKING SWITCH ACTUATOR FOR A LOW FORCE MEMBRANE CONTACT SWITCH

CROSS REFERENCE TO RELATED PATENT APPLICATION

The copending patent application of R. T. Aaron et al for "Contact Keyboard With Finger Controlled N-Key Rollover," Ser. No. 380,386, filed May 20, 1982, now abandoned and assigned to the same assignee as the assignee of this application, is incorporated by reference.

BACKGROUND OF THE INVENTION

1. Field of the Invention

This invention relates to a rocking switch actuator and, more particularly, to a rocking switch actuator for a membrane contact switch in which actuation is by depression of a key.

2. Description of the Prior Art

In U.S. Pat. No. 4,118,611 to Harris, there is shown a pivoting switch actuator using a buckling compression spring to move the actuator in response to depression of a key whereby the actuator causes closing and opening of a switch through changing the capacitance between contacts with which the actuator cooperates. The actuator of the aforesaid Harris patent pivots about a single pivot point when a key is depressed.

The present invention is an improvement of the aforesaid Harris patent in that the cost of the present invention is substantially less, approximately half, than the apparatus of the aforesaid Harris patent. The actuator of the present invention is designed so that it produces a force at least double the membrane force to close a contact switch of a membrane contact switch assembly with which the actuator cooperates. The present invention accomplishes this through transmitting substantially all of the force applied to the key to activate the contact switch of the membrane contact switch assembly.

SUMMARY OF THE INVENTION

The actuator for opening and closing the contact switch of the membrane contact switch assembly pivots about a first pivot point during depression of a key as the spring is catastrophically buckled in a selected direction. When the spring has catastrophically buckled, the rocking actuator is rotated about a second pivot point with the second pivot point being located substantially vertically above the contact switch to be closed. This enables substantially all of the force from the depressed key to be applied at the second pivot point to close the contact switch. Thus, substantially the entire force of the key is transferred, when the spring is buckled, to close the contact switch.

The rocking actuator of the present invention also avoids any undesired opening and closing of the contact switch when the key is released. This undesired opening and closing of the contact switch is avoided because the moment produced by buckling of the spring does not decrease as fast as compression of the spring when the depressed key is released whereby the actuator initially rotates further in the direction in which it rotated during depression of the key prior to rotation in the opposite direction to return the actuator to its initial rest position.

An object of this invention is to provide a switch actuator for a full travel tactile membrane keyboard.

Another object of this invention is to provide a switch actuator for a contact switch of a membrane contact switch assembly.

A further object of this invention is to provide a switch actuator having minimum bounce of the switch actuator during release of the switch actuator from the position in which it activated a contact switch.

Still another object of this invention is to control both the force required to close a contact switch of a membrane contact switch assembly and the force applied to close the contact switch.

The foregoing and other objects, features, and advantages of the invention will be apparent from the following more particular description of the preferred embodiment of the invention as illustrated in the accompanying drawings.

DETAILED DESCRIPTION

Figure 2:
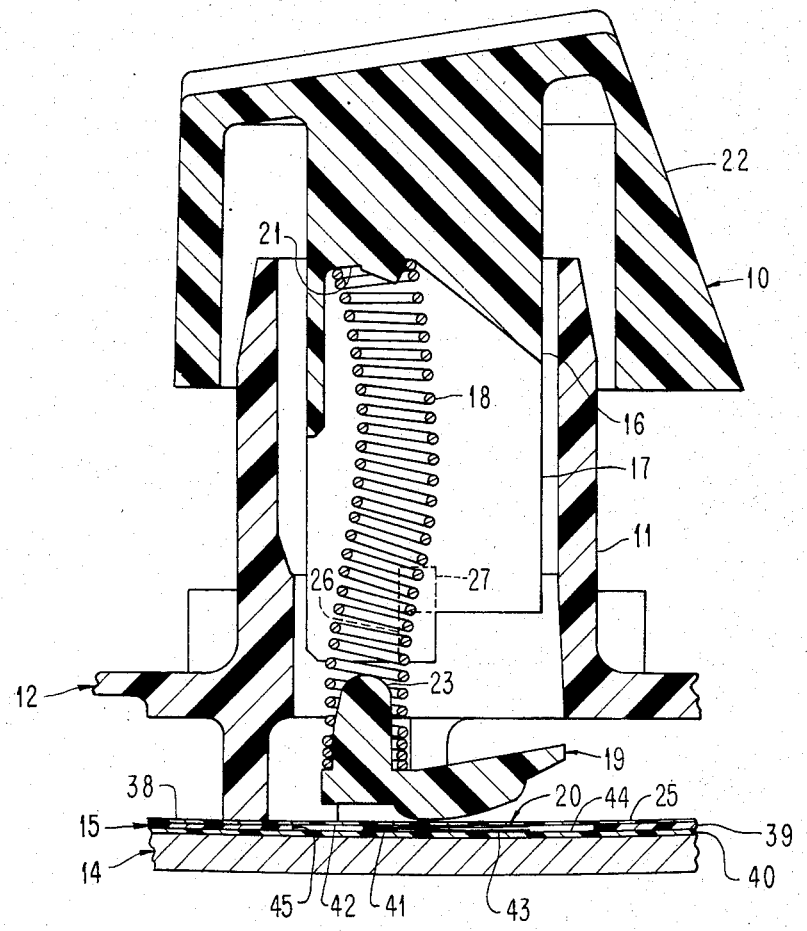
FIG. 2 is an enlarged sectional view of a key, its support, the actuator, and the membrane contact switch assembly with the key being in an inactivated position so that the actuator is in its rest position of FIG. 1.

Referring to the drawings and particularly FIG. 2, there is shown a key 10 of a keyboard of the type shown and described in the aforesaid Aaron et al application. The key 10 is employed to select one of the characters of a typewriter, for example.

The key 10 is slidably mounted on an upstanding hollow cylindrical support 11 of a frame 12. The frame 12 has one of the upstanding hollow cylindrical supports 11 for each of the keys 10 (one shown) of the keyboard.

The frame 12, which is formed of a suitable plastic as is the key 10, is attached to a metal base plate 14, which is supported by the typewriter frame. The frame 12 is attached to the base plate 14 by any suitable means. The frame 12 preferably is attached to the base plate 14 by forming the frame 12 with stepped tenons with each of the tenons extending through an opening (not shown) in the metal base plate 14 after initially passing through a larger opening (not shown) in a membrane contact switch assembly 15, which rests on the upper surface of the base plate 14. The larger portion of the stepped tenon has a shoulder at its junction with the smaller portion passing through the opening in the base plate 14 so that the shoulder rests on the upper surface of the base plate 14. The tenon is heated to form a rivet type engagement with the bottom surface of the base plate 14.

The key 10 includes a downwardly extending stem 16 extending inside of the upstanding hollow cylindrical support 11 of the frame 12 and being slidably supported thereby. The exterior of the stem 16, which is bifurcated to have two separate skirts 17 (one shown), and the interior of the upstanding hollow cylindrical support 11 have cooperating ribs and slots to orient the key 10 and to guide the key 10 during its vertical motion when it is depressed by a user and then released.

A spring 18 extends between the key 10 and a pivoting rocking actuator 19, which causes closure of a contact switch 20 of the membrane contact switch assembly 15 when the key 10 is depressed. The spring 18 has its upper end acting against a mounting base 21 in the stem 16 of the key 10. The mounting base 21 is angled slightly to set the initial deflection of the spring 18 in a selected direction (to the right in FIG. 2). This is towards the front of the typewriter as an inclined surface 22 of the key 10 is the front surface of the key 10. Any sideways buckling of the spring 18 is limited by the skirts 17 of the stem 16 of the key 10.

The spring 18 has its lower end surround an upstanding post 23 of the pivoting rocking actuator 19 and is attached thereto by a press fit. The post 23 has flat faces 24 (see FIG. 8) to aid in easier press fitting of the spring 18 (see FIG. 2) on the post 23.

The spring 18 continuously urges the key 10 upwardly since the pivoting rocking actuator 19 always is resting on upper surface 25 of the membrane contact switch assembly 15. The upward movement of the key 10 is limited by a stop 26 (one shown) on the outer surface of each of the skirts 17 of the stem 16 of the key 10 adjacent the bottom of the skirt 17 engaging a shoulder 27 (one shown) on the inner surface of the upstanding hollow cylindrical support 11 of the frame 12. Each of the stops 26 includes a slanted surface cooperating with a slanted surface on the cooperating shoulder 27 to enable each of the stops 26 to be forced beneath the cooperating shoulder 27 when the key 10 is inserted within the upstanding hollow cylindrical support 11 of the frame 12 during assembly or during replacement of the key 10.

The post 23 of the rocking actuator 19 extends upwardly from a finger 28 (see FIG. 8), which extends from a base 29 of the actuator 19. The finger 28 is intermediate two end fingers 30 and 31 of the actuator 19 extending from opposite ends of the base 29.

Figure 8:
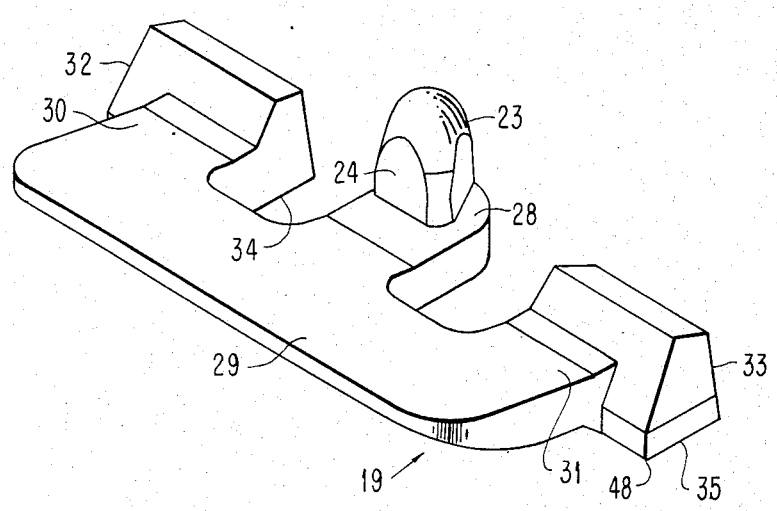
FIG. 8 is an enlarged isometric view of the rocking switch actuator of the present invention.
Figure 7:
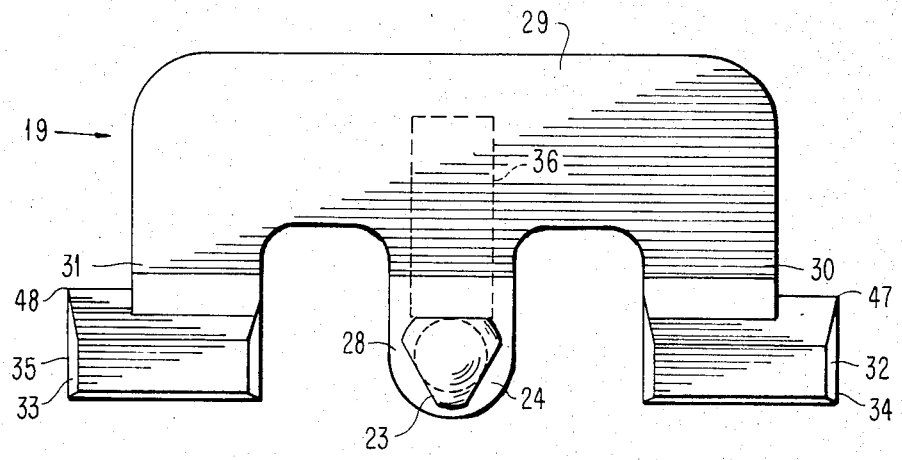
FIG. 7 is an enlarged top plan view of the rocking switch actuator of the present invention.

The actuator 19 is formed with the fingers 28, 30, and 31 so that there are spaces therebetween as shown in FIGS. 7 and 8. This enables one of the skirts 17 (see FIG. 2) of the stem 16 of the key 10 to enter the space between the fingers 28 (see FIG. 8) and 30 and the other of the skirts 17 (see FIG. 2) to enter the space between the fingers 28 (see FIG. 8) and 31 so that the skirts 17 of the stem 16 of the key 10 can move downwardly relative to the actuator 19 from the position of FIG. 2 to the position of FIG. 4.

The finger 30 (see FIG. 8) has a pad or foot 32 at its end, and the finger 31 has a foot or pad 33 at its end. The post 23 is disposed substantially perpendicular to bottom surface 34 of the pad 32 and to bottom surface 35 of the pad 33. The bottom surface 34 of the pad 32 and the bottom surface 35 of the pad 33 are disposed in the same plane.

The actuator 19 has a downwardly extending portion or protrusion 36 (see FIGS. 1 and 7) extending downwardly from the bottom surface of a portion of the finger 28 and a portion of the base 29. The downwardly extending portion 36 preferably has a curved bottom surface 37 (see FIG. 1) for its entire periphery. Thus, the downwardly extending portion 36 has its bottom surface 37 curved from the finger 28 (see FIG. 7) to the base 29 in the plane of FIG. 1 (This is from front to back.), not normal to the view.

Figure 1:
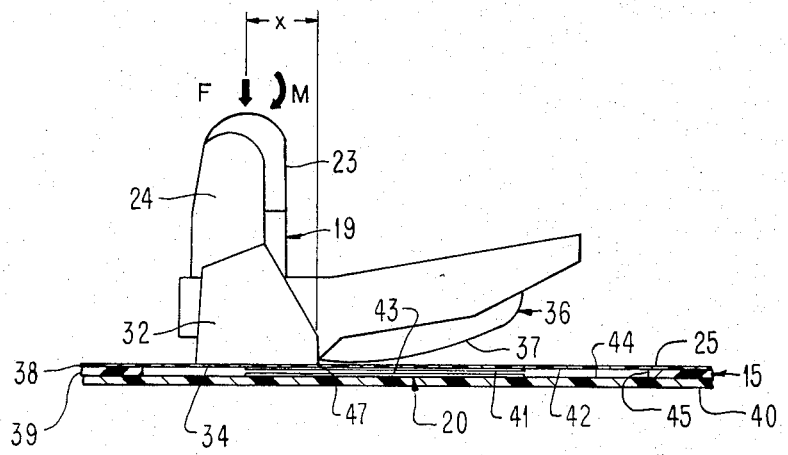
FIG. 1 is an enlarged end elevational view of a rocking actuator of the present invention in its rest position with a portion of a membrane contact switch assembly shown in section and showing the force and moment acting on the actuator from a buckling spring.

When the actuator 19 is in the rest position of FIGS. 1 and 2 in which the key 10 has not been depressed but is urged to its uppermost position by the spring 18, the actuator 19 has the bottom surface 34 (see FIG. 8) of the pad 32 and the bottom surface 35 of the pad 33 as its sole bottom surface in contact with the upper surface 25 (see FIG. 1) of the membrane contact switch assembly 15. The bottom surface 34 (see FIG. 8) of the pad 32 and the bottom surface 35 of the pad 33 are offset from the contact switch 20 (see FIG. 1) so that the spring 18 (see FIG. 2), even though compressed, is not exerting any force on the contact switch 20 when the actuator 19 is in its rest position. In this rest position, the curved surface 37 (see FIG. 1) of the downwardly extending portion 36 of the actuator 19 is slightly spaced from the upper surface 25 of the membrane contact switch assembly 15. This slight spacing is about 0.02 millimeter.

The membrane contact switch assembly 15 is formed in the manner more particularly shown and described in the aforesaid Aaron et al application. The membrane contact switch assembly 15 includes an upper layer 38 of an electrically insulating material, an intermediate layer 39 of an electrically insulating material, and a lower layer 40 of an electrically insulating material. Each of the layers 38–40 is preferably formed of Mylar. The layers 38–40 are retained in engagement with each other by a suitable glue.

The upper layer 38 of electrically insulating material has circular contacts 41 (one shown) formed on its bottom surface 42 as shown and described in the aforesaid Aaron et al application. The lower layer 40 has circular contacts 43 (one shown) formed on its upper surface 44 as shown and described in the aforesaid Aaron et al application. The contacts 42 and 43 are part of circuits as shown and described in the aforesaid Aaron et al application.

Figure 3:
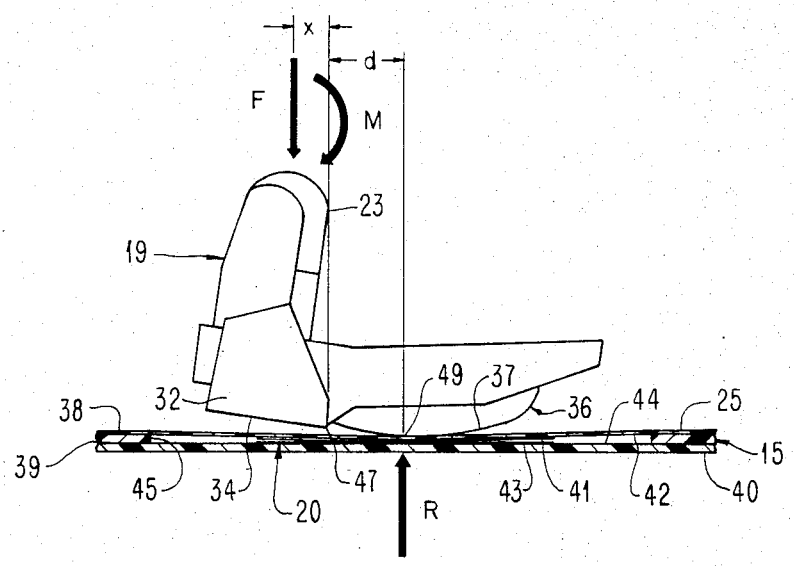
FIG. 3 is a view, similar to FIG. 1, but showing the actuator in its actuation position for closing a contact switch of the membrane contact switch assembly.

The intermediate layer 39 of electrically insulating material has a circular opening 45, which is larger than each of the contacts 41 and 43, formed therein for each set of the contacts 41 and 43, which form the contact switch 20. Thus, when the upper layer 38 is moved downwardly by the actuator 19 into the opening 45 in the intermediate layer 39 of electrically insulating material, the contact switch 20 closes because the contact 41 is moved into engagement with the contact 43 as shown in FIGS. 3 and 4.

When the actuator 19 is in its rest position of FIGS. 1 and 2, the actuator 19 has the bottom surface 34 of the pad 32 and the bottom surface 35 (see FIGS. 7 and 8) of the pad 33 as its sole bottom surface engaging the upper surface 25 (see FIG. 1) of the membrane contact switch assembly 15. This is because a force F, which represents the compression force exerted by the spring 18 (see FIG. 2) on the actuator 19, produces a moment, which is the product of the force F (see FIG. 1) and a distance x from the center of the post 23 to forward edge 47 of the bottom surface 34 of the pad 32 and forward edge 48 (see FIG. 7) of the bottom surface 35 of the pad 33, greater than a moment M, which is produced by the slight initial buckling of the spring 18 (see FIG. 2). As previously mentioned, the spring 18 is buckled in the selected direction when the key 10 is in its unactuated position.

The forward edges 47 (see FIG. 7) and 48 constitute an initial pivot point or axis about which the actuator 19 (see FIG. 1) rotates clockwise (as viewed in FIG. 1) when the moment M becomes greater than the product of F and x. At the rest position of the actuator 19, the moment M is smaller than the moment produced by the product of F and x as previously mentioned. In the rest position, the curved bottom surface 37 of the downwardly projecting portion 36 is slightly spaced from the upper surface 25 of the membrane contact switch assembly 15 as shown in FIG. 1.

Figure 4:
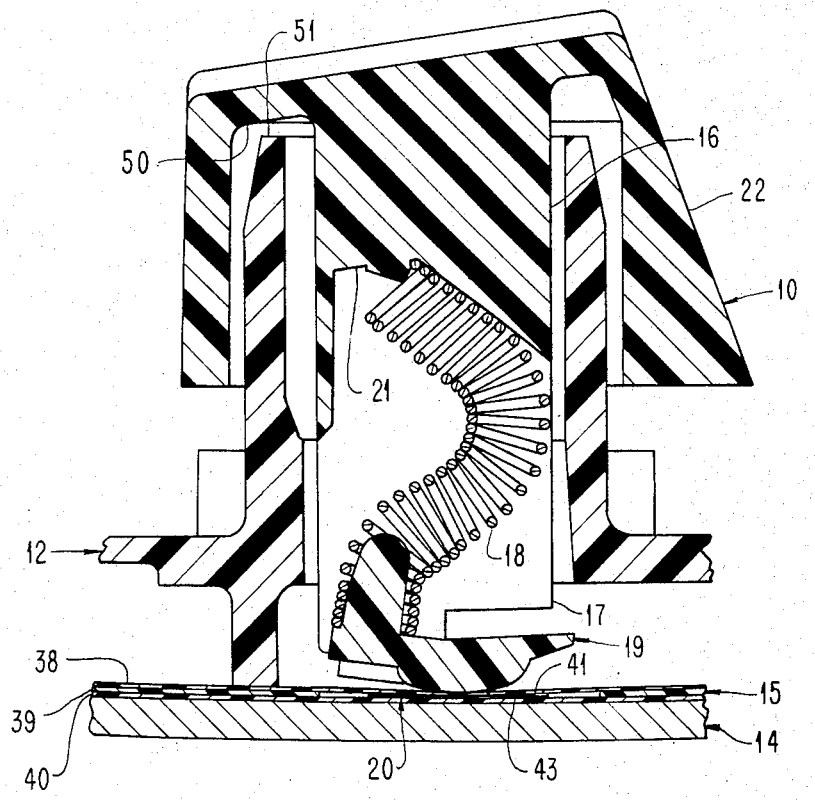
FIG. 4 is a view, similar to FIG. 2, but corresponding to the position of the actuator in FIG. 3.

When the key 10 is depressed from the position of FIG. 2 to the position of FIG. 4, the force exerted on the key 10 increases the force F (see FIG. 3) transmitted by the spring 18 (see FIG. 4) to the actuator 19. The force produced on the key 10 during its depression is illustrated with respect to the displacement of the key 10 in FIG. 9.

While the force F is increased as shown in FIG. 3 from the force F at the rest position of the actuator 19 as shown in FIG. 1 due to depression of the key 10 (see FIG. 4), the moment M (see FIG. 3), which is produced by increased buckling of the spring 18 from the position of FIG. 2 to the position of FIG. 4 due to the spring 18 catastrophically buckling, is larger than the moment produced by the product of the force F (see FIG. 3) and the distance x. As a result, the actuator 19 pivots about the initial pivot point or axis, which is defined by the edge 47 of the bottom surface 34 of the pad 32 and the edge 48 (see FIG. 7) of the bottom surface 35 of the pad 33 of the actuator 19. This clockwise (as viewed in FIGS. 1 and 3) rotation of the actuator 19 causes the curved surface 37 of the downwardly extending portion 36 of the actuator 19 to engage the upper surface 25 of the membrane contact switch assembly 15 to move the upper layer 38 of electrically insulating material downwardly into the opening 45 of the intermediate layer 39 of electrically insulating material so that the contact 41 on the bottom surface 42 of the upper layer 38 of electrically insulating material engages the contact 43 on the upper surface 44 of the lower layer 40 of electrically insulating material.

When the actuator 19 rotates clockwise about the initial pivot point or axis, the curved bottom surface 37 of the downwardly extending portion 36 of the actuator 19 makes contact at a point 49 (see FIG. 3) with the upper layer 38 of electrically insulating material of the membrane contact switch assembly 15. The point 49 is indicated in FIG. 3 as being a distance d from the initial pivot point or axis. When the actuator 19 is in the position of FIG. 3, the moment M is being opposed by a moment comprising the product of the force F and the total distance of x and d. At this time, the moment M is slightly greater than $F(x+d)$.

Since the only point of contact of the actuator 19 with the membrane contact switch assembly 15 is at the point 49, the force F is equal to a resultant force R which is at the point 49. This is a summing of the vertical forces acting on the actuator 19.

This means that substantially all of the downward force exerted on the key 10 (see FIG. 4) is transmitted to the membrane switch contact assembly 15. This relatively high force reduces bounce of the actuator 19 and causes closing of the contact switch 20.

The force F (see FIG. 3) produced by depression of the key 10 (see FIG. 4) is between forty and fifty grams when the actuator 19 is engaging the membrane contact switch assembly 15 at the point 49 (see FIG. 3). The force to close the contact switch 20 is about fifteen grams. Thus, the closing force exerted by the actuator 19 is at least twice the force required to close the contact switch 20 of the membrane contact switch assembly 15.

The force required to close the contact switch 20 is dependent upon the material of the upper layer 38 of electrically insulating material, its thickness, the size of the opening 45 in the intermediate layer 39 of electrically insulating material, and the depth of the opening 45 in the intermediate layer 39 of electrically insulating material. These are selected so that the force required to close the contact switch 20 will be less than one-half of the resultant force R acting at the point 49.

When the contact switch 20 is closed, the user feels this due to the catastrophic buckling of the spring 18 (see FIG. 4) and then releases the key 10. However, even if the user continues to depress the key 10, maximum depression of the key 10 is limited by engagement of a surface 50 of the key 10 with an upper end 51 of the upstanding hollow cylindrical support 11.

When the key 10 is released, the force F (see FIG. 5) initially decreases faster than the moment M. As a result, the moment M is still greater than $F(x+d)$ so that the actuator 19 continues to rotate clockwise to maintain continuous closing of the contact switch 20 while the bottom surface 34 of the pad 32 and the bottom surface 35 (see FIG. 8) of the pad 33 are raised further from the upper surface 25 (see FIG. 5) of the membrane contact switch assembly 15. This results in a point of contact 52 occurring between the curved bottom surface 37 of the downwardly extending portion 36 of the actuator 19 and the upper layer 38 of the electrically insulating material of the membrane contact switch assembly 15.

Figure 5:
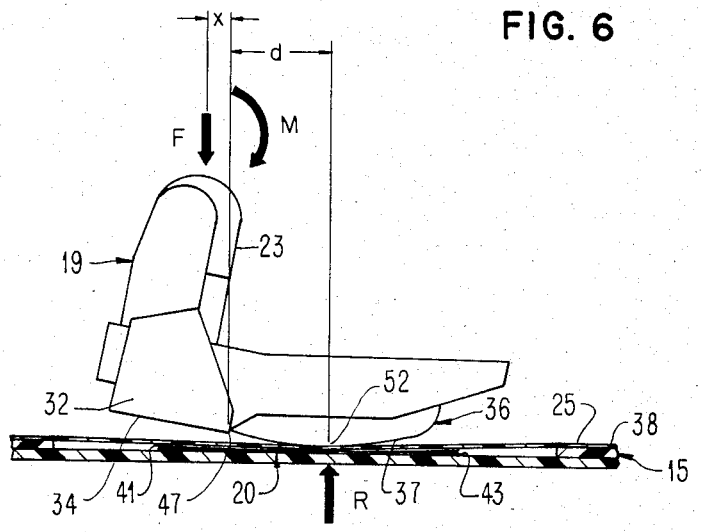
FIG. 5 is a view, similar to FIGS. 1 and 3, but showing the actuator in its position just prior to opening of the contact switch.

As can be observed by comparing FIGS. 3 and 5, the distance d increases. Eventually, the moment M decreases because of unbuckling of the spring 18 (see FIG. 6) as the released key 10 moves upwardly under the force of the spring 18. This plus the increase in the distance d results in the actuator 19 rotating counterclockwise (as viewed in FIG. 5) to return from the position of FIG. 5 to the rest position of FIG. 1. However, because of the further location of the point 52 (see FIG. 5) from the initial pivot point or axis, which is defined by the forward edge 47 of the bottom surface 34 of the pad 32 and the forward edge 48 (see FIG. 8) of the bottom surface 35 of the pad 33, there is not any undesired opening and closing of the contact switch 20. The rocking or rolling of the actuator 19 from the point 52 (see FIG. 5) to the left enables the bottom surface 34 of the pad 32 and the bottom surface 35 (see FIG. 8) of the pad 33 to return into engagement with the upper surface 25 (see FIG. 5) of the membrane contact switch assembly 15 without any excessive bounce. This is avoided by the bottom surface 37 of the downwardly extending portion 36 of the actuator 19 being curved.

Figure 9:
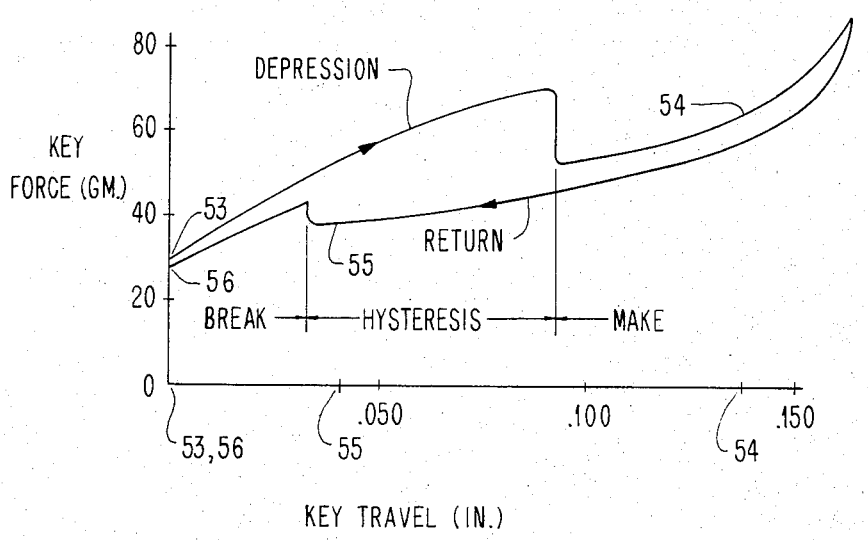
FIG. 9 is a graph illustrating the key force and its travel along with showing the position of the rocking actuator at certain positions of the key travel.

FIG. 9 discloses the relation of the force of the key 10 (see FIG. 2) relative to its travel through an entire cycle. The position of the actuator 19 at certain times also is indicated in this view.

Figure 6:
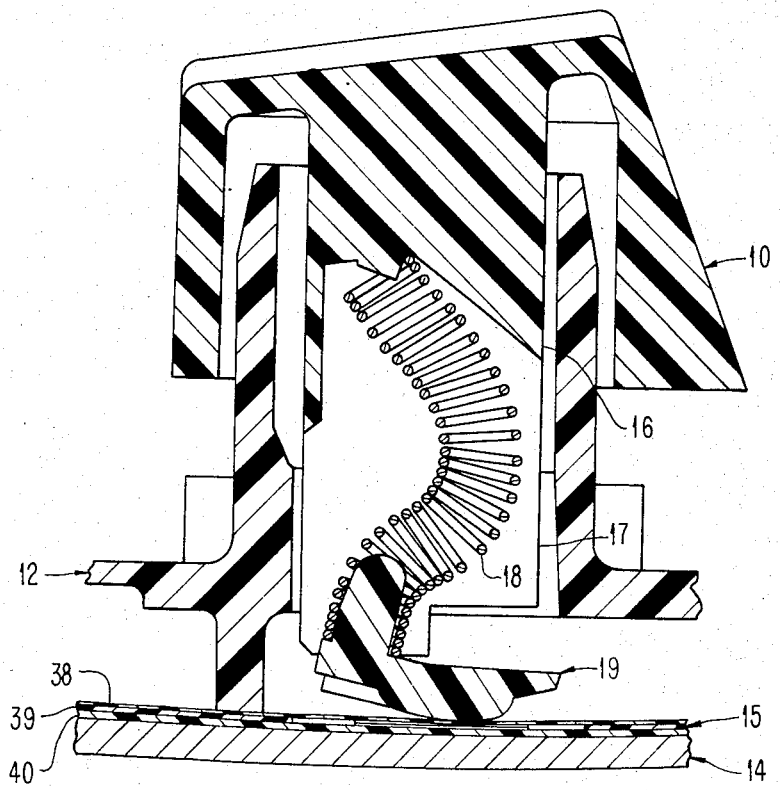
FIG. 6 is a view, similar to FIGS. 2 and 4, but corresponding to the position of the actuator in FIG. 5.

Thus, point 53 represents the position of the key 10 when the actuator 19 is in the position of FIGS. 1 and 2 in which there has been no depression of the key 10 (see FIG. 1). Point 54 indicates the position of the key 10 when the actuator 19 is in the position of FIGS. 3 and 4. The position of the key 10 when the actuator 19 is in the position of FIGS. 5 and 6 is indicated at point 55. The position of the key 10 when it has returned to its initial position and the actuator 19 is in the position of FIGS. 1 and 2 is indicated by a point 56. Points 53 and 56 are at zero travel of the key 10, but there is a slight difference in force because of friction losses during travel of the key 10.

While the bottom surface 37 (see FIG. 1) of the downwardly extending portion 36 of the actuator 19 has been shown as being a continuous curve along its entire periphery, it should be understood that a small portion of the bottom surface 37 could be flat if desired. This would be the portion of the bottom surface 37 of the downwardly extending portion 36 of the actuator 19 engaging the upper surface 25 of the membrane contact switch assembly 15 during movement of the actuator 19 from the position of FIG. 3 to the position of FIG. 5.

In the same manner as discussed relative to the aforesaid Harris patent, there is no possibility of teasing. That is, the key 10 (see FIG. 2) cannot be moved a small amount to cause opening and closing of the contact switch 20 without it being felt by the user.

This is observed from FIG. 9 in which the physical hysteresis, which is of importance in creating the non-teasability, exists in the structure since the actuator 19 (see FIG. 2) does not snap back over center until a point below that at which snap over occurred is reached. That is, the point 54 (see FIG. 9) is when there is closing of the contact switch 20 (see FIG. 2) but it does not open until after the hysteresis has been passed during the return of the key 10 (see FIG. 2) to its initial unactuated position.

As an example of relative dimensions, the layer 38 of electrically insulating material may be 0.003", the layer 39 of electrically insulating material may be 0.005", and the layer 40 of electrically insulating material may be 0.008". The base plate 14 would have a thickness of about 0.050". The radius of curvature of the curved bottom surface 37 of the downwardly extending portion 36 of the actuator 19 would be seven millimeters. As previously mentioned, the space in FIG. 1 from the curved bottom surface 37 of the downwardly projecting portion 36 of the actuator 19 to the upper surface 25 of the membrane contact switch assembly 15 is about 0.02 millimeter. These dimensions are to illustrate the relative sizes of parts, which have not necessarily been shown to scale in the drawings because of the substantial variation in sizes.

An advantage of this invention is that it produces a relatively high force for actuating a membrane switch. Another advantage of this invention is that it efficiently transmits the force from depression of a key of a keyboard to a force to close a contact switch of a membrane contact switch assembly. A further advantage of this invention is that it minimizes switch bounce during both actuation and release.

While the invention has been particularly shown and described with reference to a preferred embodiment thereof, it will be understood by those skilled in the art that other changes in form and detail may be made therein without departing from the spirit and scope of the invention.

What is claimed is:

1. A rocking switch actuator for a low force membrane contact switch including:

frame means;

a vertically movable key slidably mounted on said frame means;

a membrane contact switch assembly mounted on said frame means below said key;

said membrane contact switch assembly including a contact switch;

a rocking actuator for causing opening and closing of said contact switch, said actuator having an upper surface and a bottom surface located on said membrane contact switch assembly;

a buckling spring retained between said key and said actuator, said spring having one end acting against said key and its opposite end acting against said upper surface of said actuator, said spring being slightly compressed and slightly buckled in a selected direction when said bottom surface of said actuator is located on said membrane contact switch assembly and said key is not actuated;

said bottom surface of said actuator including a first surface on which said actuator rests on said membrane contact switch assembly when said key is not actuated so that said actuator is in its rest position, said first surface being disposed relative to said contact switch so that the force of said spring when said actuator is in its rest position cannot cause closure of said contact switch;

said actuator having a downwardly extending portion located adjacent said contact switch of said membrane contact switch assembly and having its bottom surface form part of said bottom surface of said actuator, said bottom surface of said downwardly extending portion being curved along its periphery from at least said first surface to at least where closure of said contact switch by said actuator occurs;

downward actuation depression of said key causing said spring to compress and to buckle further in the selected direction to produce rotation of said actuator from its rest position to cause said downwardly extending portion to rotate downwardly on said contact switch to effect closure thereof and to lift said first surface from said membrane contact switch assembly, and release of said key causing said spring to unbuckle to rotate said actuator back to said first surface to open said contact switch;

and said actuator including means to prevent extra opening and closure of said contact switch during return of said actuator to its rest position.

2. The rocking switch actuator according to claim 1 in which said downwardly extending portion of said actuator has its bottom surface curved for its entire periphery.

3. The rocking switch actuator according to claim 1 in which said preventing means of said actuator enables said actuator to rotate first further on said bottom surface of said downwardly extending portion in the direction in which said downwardly extending portion rotated from its rest position to close said contact switch to prevent extra opening and closure of said contact switch while maintaining said contact switch closed and thence back to said first surface to open said contact switch.

4. The rocking switch actuator according to claim 1 in which said bottom surface of said downwardly extending portion of said actuator is spaced from said membrane contact switch assembly when said actuator is in its rest position.

5. The rocking switch actuator according to claim 1 in which:

said first surface of said bottom surface of said actuator has a portion forming a first pivot axis about which rotation of said actuator occurs from its rest position;

and said bottom surface of said downwardly extending portion of said actuator has a portion forming a second pivot axis, spaced from the pivot axis, about which rotation of said actuator initially occurs upon release of said key after closing of said contact switch.

6. The rocking switch actuator according to claim 1 in which:

said membrane contact switch assembly includes:

an upper layer of electrically insulating material having an electrical contact extending downwardly from its lower surface;

a lower layer of electrically insulating material having an electrical contact extending upwardly from its upper surface for cooperation with said contact on said upper layer of electrically insulating material;

said contacts on said upper layer of electrically insulating material and said lower layer of electrically insulating material forming said contact switch;

and an intermediate layer of electrically insulating material between said upper layer of electrically insulating material and said lower layer of electrically insulating material and secured to each, said intermediate layer of electrically insulating material having an opening therein to enable said contact on said upper layer of electrically insulating material to be moved therein to engage said contact on said lower layer of electrically insulating material when said upper layer of electrically insulating material is moved downwardly by said actuator to produce closure of said contact switch;

and said downwardly extending portion of said actuator being positioned over the portion of said upper layer of electrically insulating material having said contact.

7. The rocking switch actuator according to claim 6 in which said downwardly extending portion of said actuator is smaller than said opening in said intermediate layer of electrically insulating material.

8. The rocking switch actuator according to claim 7 in which said key has means to initially orient said spring so that said spring buckles in the selected direction.

9. The rocking switch actuator according to claim 8 in which said first surface of said bottom surface of said actuator has a forward edge forming a first pivot axis about which rotation of said actuator occurs from its rest position.

10. The rocking switch actuator according to claim 1 in which:

said first surface of said bottom surface of said actuator includes first and second portions spaced from each other and disposed on opposite sides of said contact switch;

and said downwardly extending portion of said actuator is disposed between said first and second portions of said first surface of said bottom surface of said actuator and above said contact switch.

11. The rocking switch actuator according to claim 10 in which:

said membrane contact switch assembly includes:

an upper layer of electrically insulating material having an electrical contact extending downwardly from its lower surface;

a lower layer of electrically insulating material having an electrical contact extending upwardly from its upper surface for cooperation with said contact on said upper layer of electrically insulating material;

said contacts on said upper layer of electrically insulating material and said lower layer of electrically insulating material forming said contact switch;

and an intermediate layer of electrically insulating material between said upper layer of electrically insulating material and said lower layer of electrically insulating material and secured to each, said intermediate layer of electrically insulating material having an opening therein to enable said contact on said upper layer of electrically insulating material to be moved therein to engage said contact on said lower layer of electrically insulating material when said upper layer of electrically insulating material is moved downwardly by said actuator to produce closure of said contact switch;

and said downwardly extending portion of said actuator being positioned over the portion of said upper layer of electrically insulating material having said contact.

12. The rocking switch actuator according to claim 11 in which said downwardly extending portion of said actuator is smaller than said opening in said intermediate layer of electrically insulating material.

13. The rocking switch actuator according to claim 12 in which said key has means to initially orient said spring so that said spring buckles in the selected direction.

14. The rocking switch actuator according to claim 13 in which each of said first and second portions of said first surface of said bottom surface of said actuator has a forward edge forming a first pivot axis about which rotation of said actuator occurs from its rest position.

15. The rocking switch actuator according to claim 14 in which said downwardly extending portion of said actuator has its bottom surface curved for its entire periphery.

16. The rocking switch actuator according to claim 15 in which said preventing means of said actuator enables said actuator to rotate first further on said bottom surface of said downwardly extending portion in the direction in which said downwardly extending portion rotated from its rest position to close said contact switch to prevent extra opening and closure of said contact switch while maintaining said contact switch closed and thence back to said first surface to open said contact switch.

17. A rocking switch actuator for a low force membrane contact switch including:

frame means;

a vertically movable key slidably mounted on said frame means;

a membrane contact switch assembly mounted on said frame means below said key;

said membrane contact switch assembly including a contact switch requiring a predetermined force to close it;

a rocking actuator for causing closing and opening of said contact switch, said actuator having an upper surface and a bottom surface located on said membrane contact switch assembly;

a buckling spring retained between said key and said actuator, said spring having one end acting against said key and its opposite end acting against said upper surface of said actuator, said spring being slightly compressed and slightly buckled in a selected direction when said bottom surface of said actuator is located on said membrane contact switch assembly and said key is not actuated;

said actuator having a downwardly extending portion located adjacent said contact switch of said membrane contact switch assembly, said downwardly extending portion having its bottom surface curved along its periphery from at least where said bottom surface initially rolls on said membrane contact switch assembly to at least where closure of said contact switch by said actuator occurs;

said actuator being mounted to rotate from its rest position relative to said membrane contact switch assembly during downward actuation depression of said key to produce a force on said contact switch of said membrane contact switch assembly exceeding the predetermined force by a predetermined amount to close said contact switch only after said buckling spring has buckled a selected distance in the selected direction during depression of said key;

and said actuator maintaining said contact switch closed during a selected period of time after release of said key by maintaining a force on said contact switch of said membrane contact switch assembly greater than the predetermined force to close said contact switch, said actuator including means to prevent extra opening and closure of said contact switch during return of said actuator to its rest position after the selected period of time.

18. The rocking switch actuator according to claim 17 in which said downwardly extending portion of said actuator has its bottom surface curved for its entire periphery.

19. The rocking switch actuator according to claim 17 in which:

said bottom surface of said actuator has a portion forming a first pivot axis about which rotation of said actuator occurs from its rest position;

and said bottom surface of said downwardly extending portion of said actuator has a portion forming a second pivot axis, spaced from the first pivot axis, about which rotation of said actuator initially occurs upon release of said key after closing of said contact switch.

20. The rocking switch actuator according to claim 17 in which:

said membrane contact switch assembly includes:

an upper layer of electrically insulating material having an electrical contact extending downwardly from its lower surface;

a lower layer of electrically insulating material having an electrical contact extending upwardly from its upper surface for cooperation with said contact on said upper layer of electrically insulating material;

said contacts on said upper layer of electrically insulating material and said lower layer of electrically insulating material forming said contact switch;

and an intermediate layer of electrically insulating material between said upper layer of electrically insulating material and said lower layer of electrically insulating material and secured to each, said intermediate layer of electrically insulating material having an opening therein to enable said contact on said upper layer of electrically insulating material to be moved therein to engage said contact on said lower layer of electrically insulating material when said upper layer of electrically insulating material is moved downwardly by said actuator to produce closure of said contact switch;

and said downwardly extending portion of said actuator being positioned over the portion of said upper layer of electrically insulating material having said contact.

21. The rocking switch actuator according to claim 20 in which said downwardly extending portion of said actuator is smaller than said opening in said intermediate layer of electrically insulating material.

22. The rocking switch actuator according to claim 21 in which said key has means to initially orient said spring so that said spring buckles in the selected direction.

23. The rocking switch actuator according to claim 22 in which said downwardly extending portion of said actuator has its bottom surface curved for its entire periphery.

* * * * *